US007958764B2

(12) United States Patent
Mehta et al.

(10) Patent No.: US 7,958,764 B2
(45) Date of Patent: Jun. 14, 2011

(54) METHOD FOR PROVIDING AN ARMATURE HOUSING

(75) Inventors: Shreyas R. Mehta, Scarsdale, NY (US); Hassan Chelura Iyenger Parthasarathy, Chennai (IN); Narayanan Jayasankar, Chennai (IN)

(73) Assignee: Indimet Inc., White Plains, NY (US)

( * ) Notice: Subject to any disclaimer, the term of this patent is extended or adjusted under 35 U.S.C. 154(b) by 64 days.

(21) Appl. No.: 12/370,212

(22) Filed: Feb. 12, 2009

(65) Prior Publication Data

US 2009/0205393 A1 Aug. 20, 2009

Related U.S. Application Data

(63) Continuation-in-part of application No. 12/102,392, filed on Apr. 14, 2008.

(60) Provisional application No. 61/028,967, filed on Feb. 15, 2008.

(51) Int. Cl.
*B21C 23/00* (2006.01)
*B21C 1/00* (2006.01)

(52) U.S. Cl. ..... 72/256; 72/707

(58) Field of Classification Search ..... 72/352, 72/356, 358, 359, 377, 256, 707
See application file for complete search history.

(56) References Cited

U.S. PATENT DOCUMENTS

| | | | | |
|---|---|---|---|---|
| 2,350,491 | A | 6/1944 | Butler et al. | |
| 3,848,312 | A * | 11/1974 | Kirkham | 419/28 |
| 3,928,995 | A * | 12/1975 | Oldis et al. | 72/60 |
| 4,217,567 | A | 8/1980 | Roy et al. | |
| 4,290,295 | A * | 9/1981 | Kanamaru et al. | 72/356 |
| 4,365,223 | A | 12/1982 | Fechant et al. | |
| 4,423,617 | A * | 1/1984 | Nippert | 72/356 |
| 4,580,431 | A * | 4/1986 | Oku et al. | 72/359 |
| 4,945,749 | A * | 8/1990 | Walker et al. | 72/356 |
| 5,937,692 | A | 8/1999 | Weyand | |
| 6,029,704 | A | 2/2000 | Kuroda et al. | |
| 6,908,517 | B2 * | 6/2005 | Segal et al. | 148/559 |
| 2004/0250593 | A1 * | 12/2004 | Takagi | 72/340 |
| 2005/0016246 | A1 * | 1/2005 | Yamanaka et al. | 72/355.6 |
| 2005/0168310 | A1 | 8/2005 | Nickel et al. | |
| 2006/0087603 | A1 | 4/2006 | Lee | |

FOREIGN PATENT DOCUMENTS

| | | | |
|---|---|---|---|
| JP | 10-202339 | A | 8/1998 |
| JP | 2001-038447 | A | 2/2001 |
| JP | 2007-181878 | A | 7/2007 |

* cited by examiner

*Primary Examiner* — Dana Ross
*Assistant Examiner* — Mohammad Yusuf
(74) *Attorney, Agent, or Firm* — IP Attorneys Group, LLC

(57) ABSTRACT

The invention relates to a method of providing an armature housing having the steps of providing a solid cylinder of malleable material having a first part and a second part; raising at least a part of a perimeter of the first part in a direction away from the second part for defining a raised wall; compressing the second part in an axial direction toward the first part, resulting in a flattened disc generally perpendicular to the first part; and wherein the first part, second part, and at least part of the perimeter are all integrally connected as a single piece.

13 Claims, 12 Drawing Sheets

METHOD FOR PROVIDING AN ARMATURE HOUSING

CROSS REFERENCED TO RELATED APPLICATION

This is a continuation-in-part non-provisional patent application that claims priority to and the benefit of U.S. Provisional Patent Application No. 61/028,967 filed Feb. 15, 2008, titled Armature Frame, and U.S. Non-Provisional patent application Ser. No. 12/102,392 filed Apr. 14, 2008, titled Method of Providing a Solenoid Housing, both of which are incorporated herein by reference in its entirety.

FIELD OF THE INVENTION

The invention relates to a housing for an armature.

BACKGROUND OF THE INVENTION

In some motors, an armature rotates to make the transfer of electricity across the motor possible. The spinning of the armature often enables the motor shaft to also spin. Because the armature normally rotates or spins, it is usually mounted on ball bearings and a housing is usually placed around the armature and/or bearings to protect them from debris.

In other motors, an armature may be associated with gears or valves and a housing is usually employed to protect the armature, gears, or valves from debris in order to enable proper operation of these parts.

The housing for the armature is typically assembled in parts, where flattened disc 8 is welded or attached in any fashion to cylinder 12. In other embodiments, cylinder 12 is a cup (see FIGS. 1*a*-1*b*). These components may be cut from sheet metal and bent to achieve the shape shown, where cutting and bending often increase manufacturing time and labor. After the components are cut and bent, they further need to be assembled together.

Another way of providing an armature housing may be to machine the various pieces in addition to or instead of assembling the pieces together. Some methods include machining at least a part of cylinder 12 or disc 8.

However, making an armature housing in the manners described above presents several disadvantages. When assembling the parts together, a weak point may be introduced when attaching cylinder 12 to disc 8 and any mechanical failure is usually located at the junction between cylinder 12 and disc 8.

In addition, since an electromagnetic field typically flows from disc 8 to cylinder 12, a bottle neck frequently occurs at the juncture of disc 8 and cylinder 12 because disc 8 is of sheet metal and its thinness provides a small cross section through which the electromagnetic field may flow. As a consequence, such electromagnetic field will ordinarily be impeded.

Further, one can argue the orientation of the grain structure of disc 8 and cylinder 12 inhibits the flow of the electromagnetic field because the grain structure may be perpendicular or angular relative to the radially traveling electromagnetic field. Since disc 8 or cylinder 12 is usually cut from sheet metal, the orientation of the grain structure is usually not known and often is not predictable or adjustable.

With regard to machining parts of disc 8 or cylinder 12, such practice is normally labor intensive and usually time consuming because no more than several thousandths or hundredths of an inch may be removed at a time, and removing material at this rate often translates to long periods of time for producing a armature. Moreover, the lathes used for machining parts are often expensive and require a large amount of space for proper operation. Therefore, any benefits obtained from machining parts over assembling parts may be outweighed by the associated costs.

U.S. Pat. No. 4,217,567 appears in FIGS. 10 and 10A to relate to a simple soft iron plug or insert 75 with a conforming nose portion pressed as interference fit into the external hollow space formed by the inwardly extending pole portion 52. The plug 75 has the effect of increasing the flux-carrying capacity across the gap defined by the wall 60 of the bobbin 55. Substantially the same effect may be achieved, at still lower cost, in which the flux carrying plug means comprises one or more mild steel balls 76 pressed into the hollow external cavity defined by the pole portion 52.

U.S. Pat. No. 6,029,704 Kuroda et al. appears to disclose a press formed or cold forged steel plate and a hollow cylindrical housing. However, because Kuroda's housing is made from multiple parts and assembled, it does not efficiently conduct the electromagnetic field.

U.S. Pat. No. 4,365,223 to Fechant et al. relates to a housing that may be put together in pieces.

What is desired, therefore, is a method of making an armature housing that reduces weak points without sacrificing manufacturing efficiency. Another desire is a method of making an armature housing that enhances a flow of an electromagnetic field.

SUMMARY OF THE INVENTION

It is therefore an object of the invention to provide a way of making an armature housing without the weak points and disadvantages of the prior art.

A further object is a housing that enhances a flow of electromagnetic field.

Yet another object is a housing that is provided from a single slug of material and with reduced manufacturing costs.

These and other objects of the invention are achieved by a method of providing an armature housing having the steps of providing a solid cylinder of malleable material having a first part and a second part; raising at least a part of a perimeter of the first part in a direction away from the second part for defining a raised wall; compressing the second part in an axial direction toward the first part, resulting in a flattened disc generally perpendicular to the first part; and wherein the first part, second part, and at least part of the perimeter are all integrally connected as a single piece.

In another embodiment, the method further includes the step of placing at least one hole in the flattened disc. In some embodiments, the method cuts the flattened disc. In a further embodiment, the method shapes the flattened disc. In an optional embodiments the method includes polishing the first part and the second part.

In other embodiments, the method includes shaping an area defined by a junction of the first part and the second part. In yet another embodiment, the method magnetically anneals the armature housing after at least one of the steps of: providing a solid cylinder of malleable material having a first part and a second part; raising at least a part of a perimeter of the first part in a direction away from the second part for defining a raised wall; and compressing the second part in an axial direction toward the first part, resulting in a flattened disc generally perpendicular to the first part.

In some embodiments, the method includes controlling a cross section of the flattened disc relative to a cross section of the at least part of the raised wall. In some of these embodiments, the method reduces a thickness of the raised wall to be less than a thickness of the flattened disc.

In a more specific embodiment, the method orients a plurality of grain lines of the flattened disc to be in a generally radial direction extending outwardly from a general center of the flattened disc. In a more specific embodiment, the method orients a plurality of grain lines of the first part to be in a generally axial direction extending along a length of the raised wall. In another embodiment, the method includes the step of extending a central part of the flattened disc away from the first part, resulting in a boss.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 2-13 of the drawings in which like numerals refer to like features of the invention.

Figure 2:
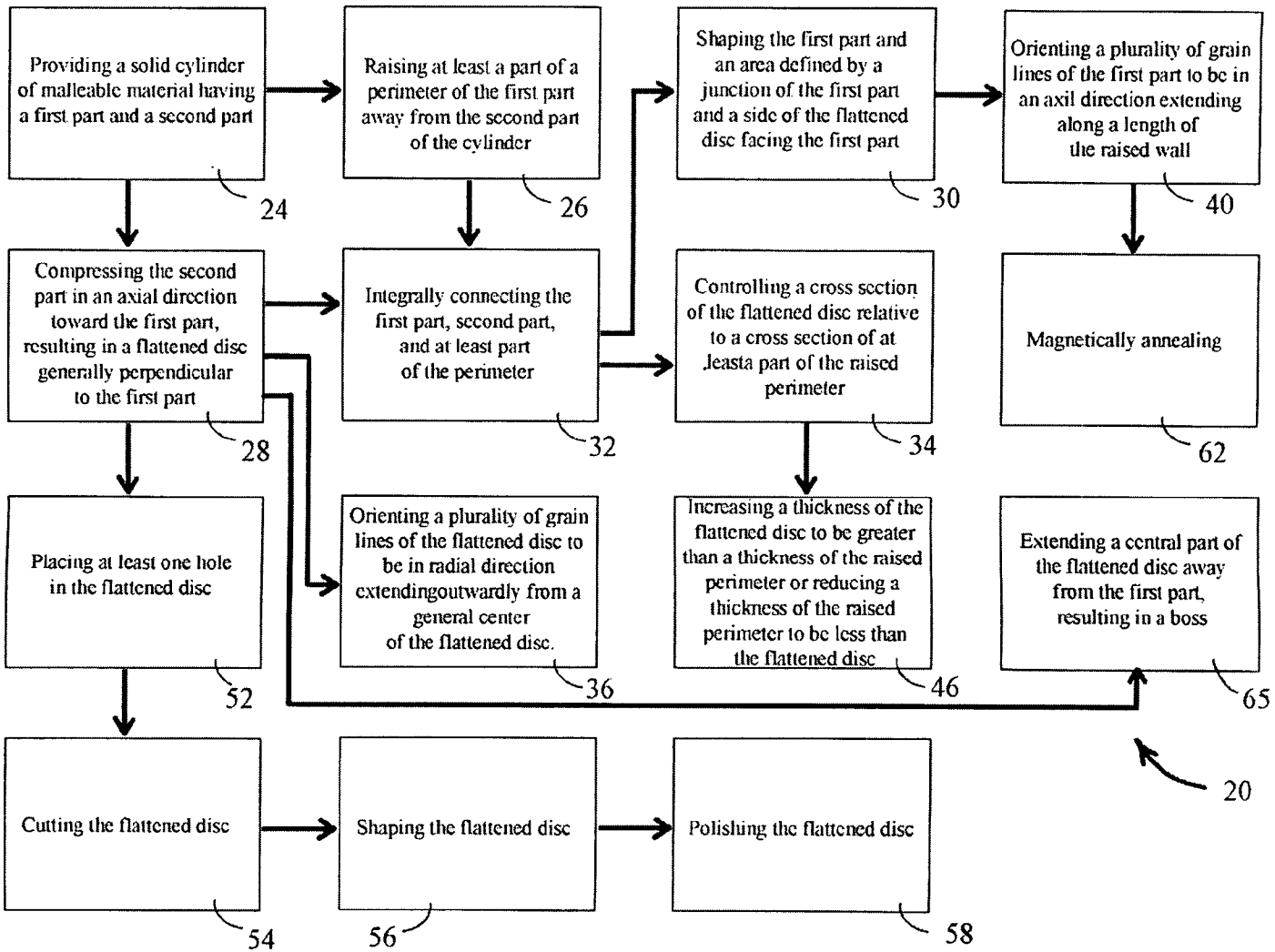
FIG. 2 depicts a method for providing an armature housing in accordance with the invention.

FIG. 2 depicts method 20 for providing an armature housing in accordance with the invention, where armature housing 102 (see FIG. 12*d*) is produced by method 20 from a single unit of a solid cylinder of malleable material 106. An advantage of method 20 is it minimizes material loss typically associated with traditional methods of making an armature housing, where the traditional housing is often cut or machined resulting in waste. Another advantage is a reduction in manufacturing time because traditional methods often require assembly in addition to cutting, drilling, and/or machining time. In some embodiments, material 106 is low carbon steel, such as SAE 1006, 1008, 1010, and the like.

As shown in FIG. 2, method 20 includes the steps of providing 24 a solid cylinder of malleable material having a first part and a second part, raising 26 at least a part of a perimeter of the first part in a direction away from the second part for defining a raised wall, and compressing 28 the second part in an axial direction toward the first part, wherein the first part, second part, and at least part of the perimeter are all integrally connected 32 as a single piece.

Figures 3A, 3B, 3C:
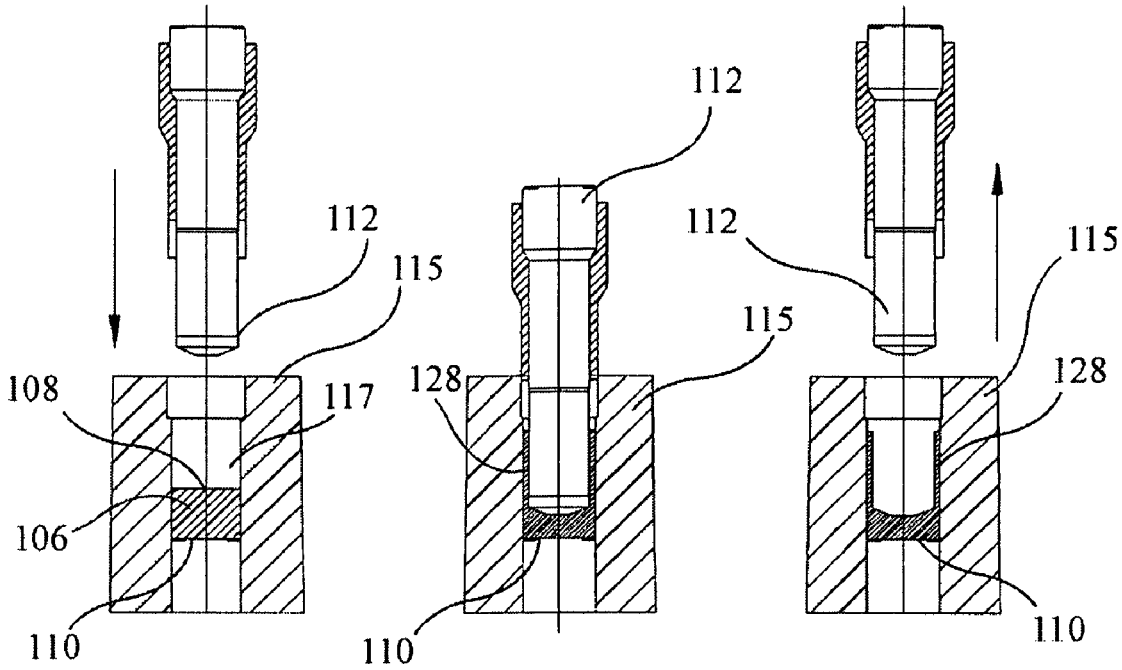
FIGS. 3A-3C depict the steps for raising at least a perimeter of a first part provided by the method shown in FIG. 2.

FIGS. 3A-3C depict punch 112 and first die 115 used during the step for raising 26 at least a perimeter of first part 108. As shown, material 106 is placed within first die 115 and punch 112 is brought downwards into material 106. Because a diameter of punch 112 is less than a diameter of orifice 117 in die 115, material of first part 108 is extruded upwards, or backward extruded, in the opposite direction of the movement of punch 112. As a result, when punch 112 is removed, first part 108 includes at least a part of perimeter 128 that is raised. See FIGS. 3C-4B.

Figure 4A:
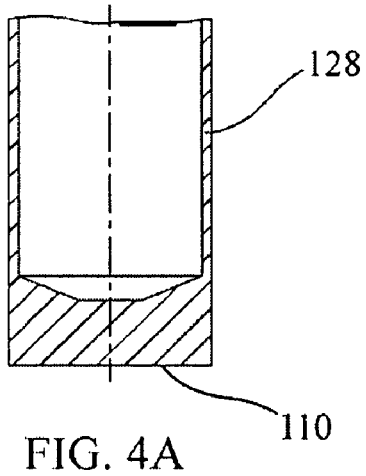
FIGS. 4A-4B depict the raised wall of an armature housing provided by the method shown in FIG. 2.
Figure 4B:
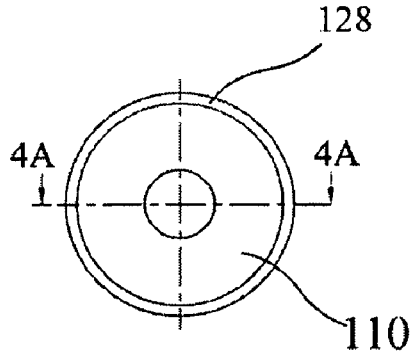

FIG. 4A shows at least a part of a perimeter 128 of first part 108 for defining a raised wall, or raised lip. FIG. 4*b* shows raised wall 128, which is shown to extend around an entire perimeter of first part 108. In other embodiments, raised wall 128 extends around a part of the entire perimeter of first part 108.

Figure 5A:
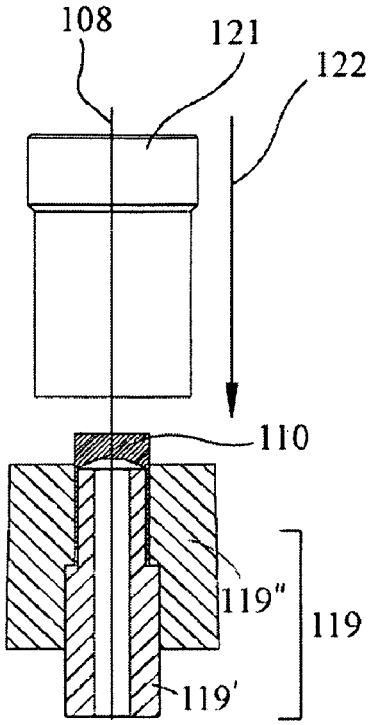
FIGS. 5A-5C depict the steps for compressing a second part of the housing provided by the method shown in FIG. 2.
Figure 5B:
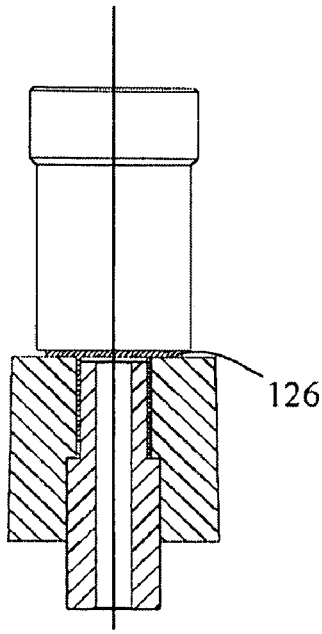
Figure 5C:
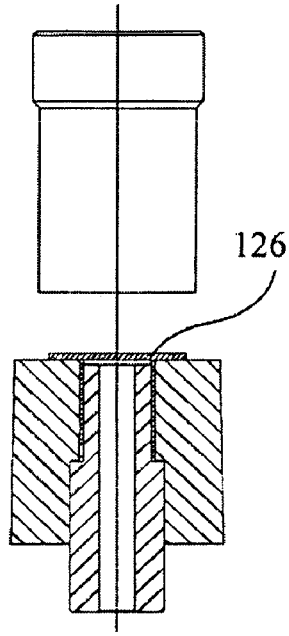

FIGS. 5A-5C show the step of compressing 28 second part 110 in the direction of arrow 122 with second punch 121, resulting in flattened disc 126 that is generally perpendicular to an axis passing longitudinally through first part 108. In some embodiments, these steps shown in FIGS. 5A-5C for providing flattened disc 126 are known as upsetting. As shown, during the compressing 28 step where second part 110 is flattened into disc 126, first part 108 is securely held in place by second die 119 (or dies 119' and 119" that work together to hold first part 108) that is shaped with chamfers or other contours which results in the chamfers and/or contours being imparted to first part 108 after the compressing step. In other embodiments, first part 108 is held in place by first die 115.

Figure 6A:
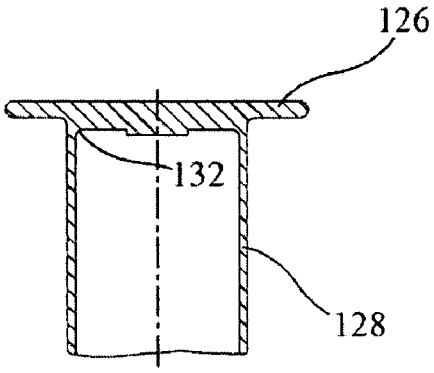
FIGS. 6A-6B the flattened disc provided by the method shown in FIG. 2.
Figure 6B:
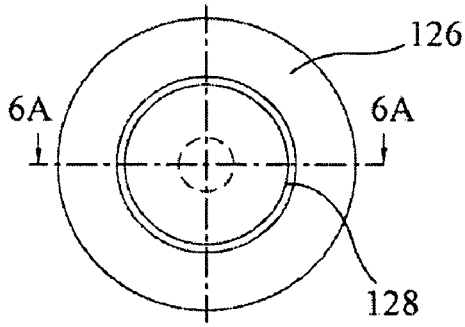

FIGS. 6A-6B depict armature housing 102 when second part 110 is compressed following the steps shown in FIGS. 5A-5C, where flattened disc 126 is integrally attached to raised wall 128 as a single unit.

Figure 7A:
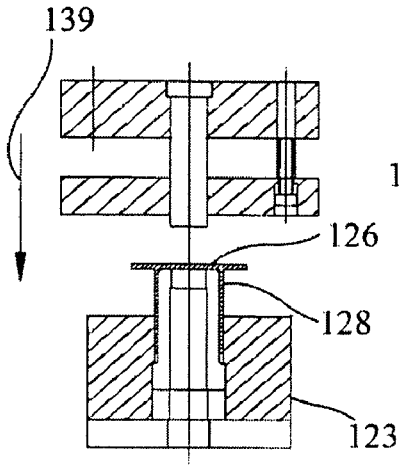
FIGS. 7A-7C depict the steps for placing at least one hole in the housing provided by the method shown in FIG. 2.
Figure 7B:
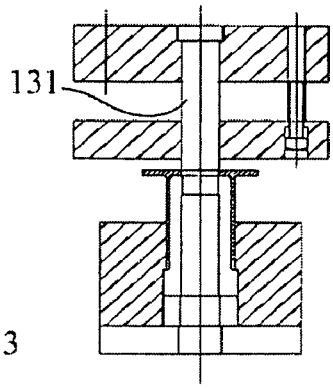
Figure 7C:
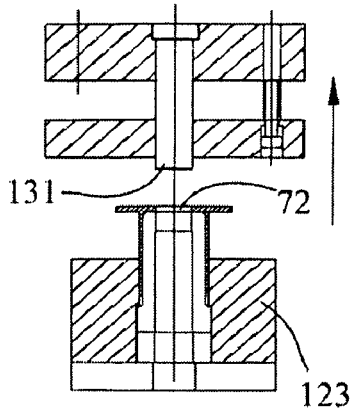
Figure 8A:
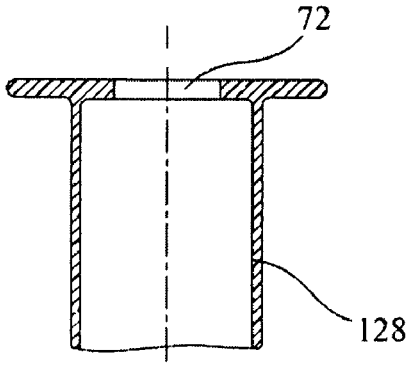
FIGS. 8A-8B depict the housing with a center hole provided by the method shown in FIG. 2.
Figure 8B:
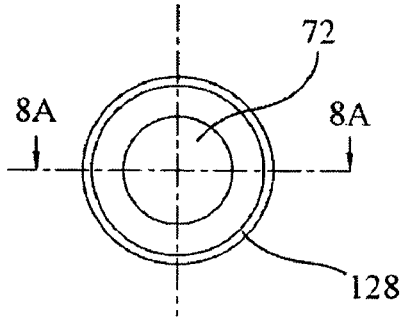

As shown in FIG. 2, some embodiments of method 20 include the step of placing 52 at least one hole in flattened disc 126. FIGS. 7A-7C depict raised wall 128 being held in place by die 123 and punch 131 being brought downwardly in the direction of arrow 139, where punch 131 makes contact with and passes through flattened disc 126 to create hole 72 in a general center of flattened disc 126. See FIGS. 8A-8B.

Figure 9A:
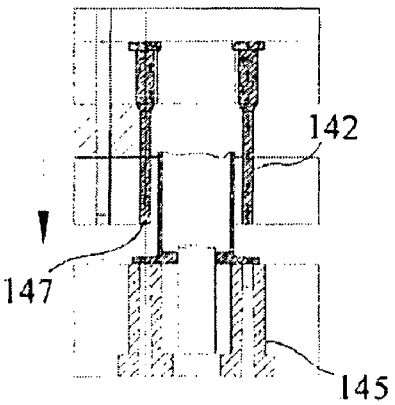
FIGS. 9A-9C depict the steps for placing additional holes in the housing provided by the method shown in FIG. 2.
Figure 9B:
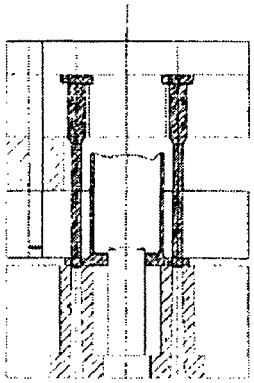
Figure 9C:
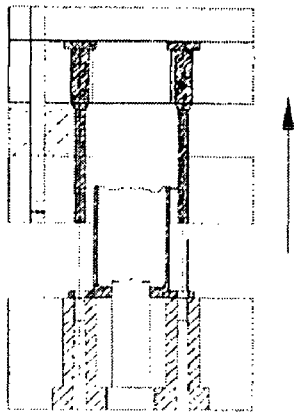
Figure 10A:
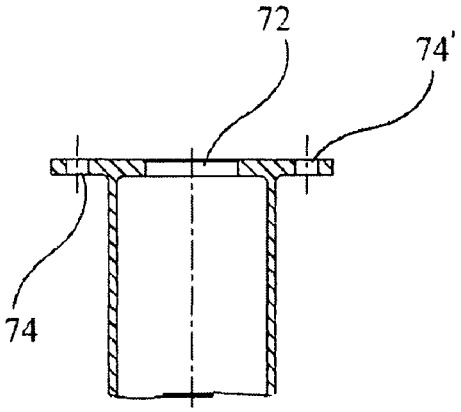
FIGS. 10A-10B depict the housing with side holes provided by the method shown in FIG. 2.
Figure 10B:
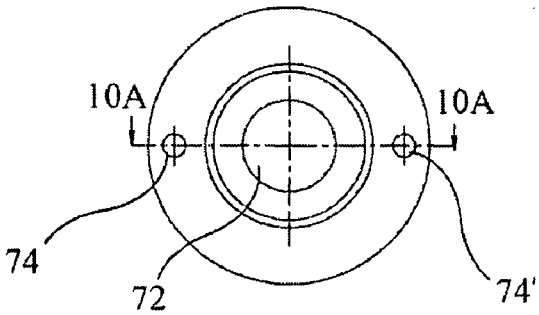

FIGS. 9A-9C depict other embodiments where method places 52 two side holes 74, 74' in flattened disc 126 in addition to or instead of center hole 72. As shown, flattened disc 126 is held in place by die 145 and punch 147 is brought downwardly, where punch 147 makes contact with and passes through flattened disc 126 to create two side holes 74, 74'. See FIGS. 10*a*-10*b*.

Figure 11A:
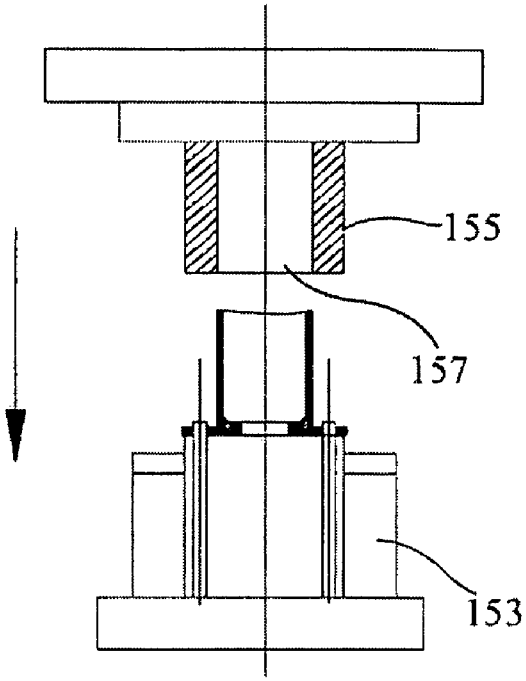
FIGS. 11A-11B depict the steps for shaping the flattened disc provided by the method shown in FIG. 2.
Figure 11B:
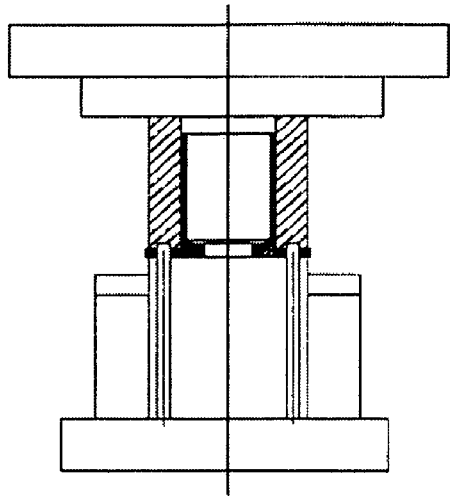
Figure 12A:
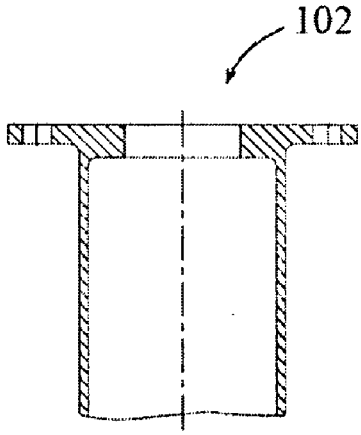
FIGS. 12A-12B depict the flattened disc shaped by the method shown in FIG. 2.
Figure 12B:
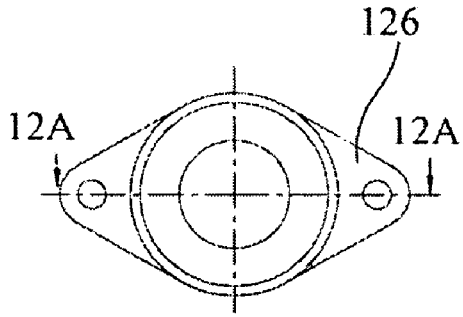
Figure 13:
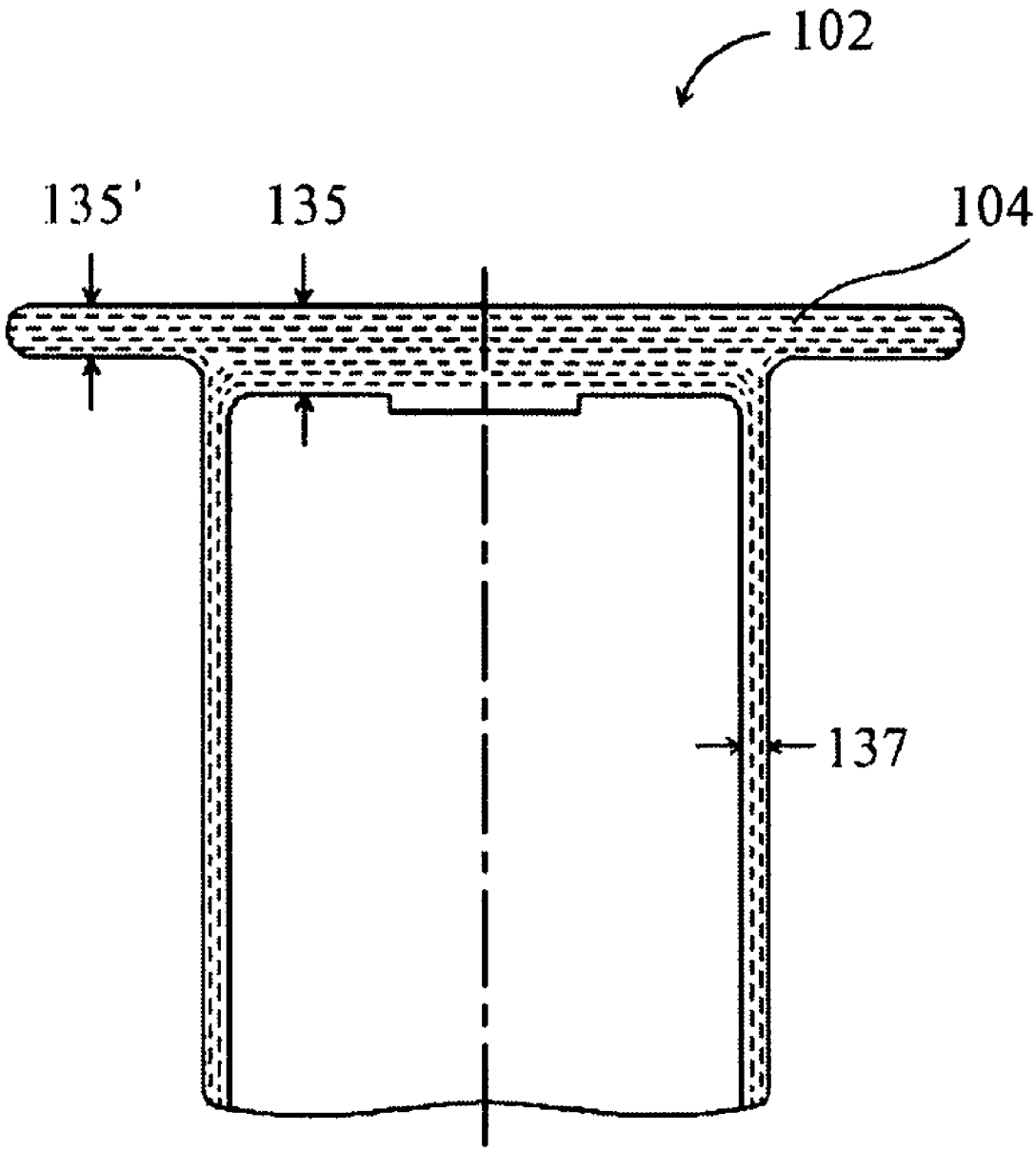
FIG. 13 depicts the housing provided by the method shown in FIG. 2.

In other embodiments, FIG. 2 depicts the step of cutting 54 the flattened disc. Additional embodiments include shaping 56 the flattened disc. As shown in FIGS. 11A-11B, flattened disc 126 is held in place by die 153 and punch 155 with hole 157 is brought downwardly, where punch 155 makes contact with and passes through flattened disc 126 to cut or create a geometric shape of flattened disc 126 consistent with hole 157. See FIGS. 12A-12B where the geometric shape generally resembles that of an oval.

Figure 14C:
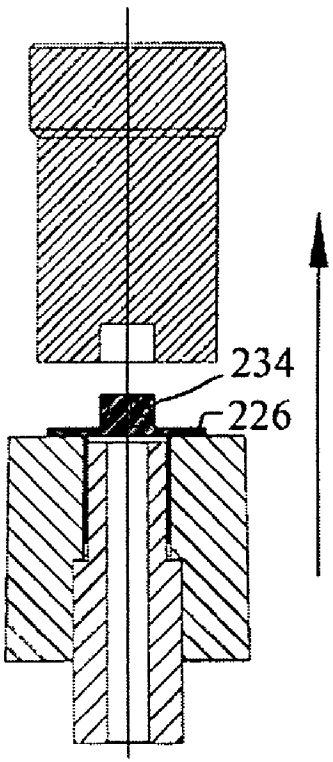
FIGS. 14A-14C depict another embodiment of the steps for compressing a second part of the housing provided by the method shown in FIG. 2.
Figure 14B:
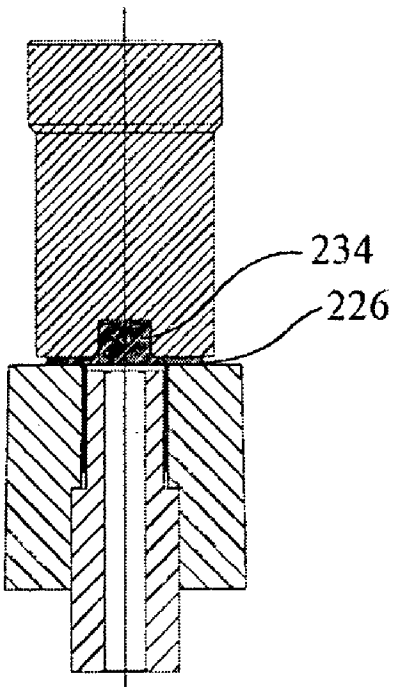
Figure 14A:
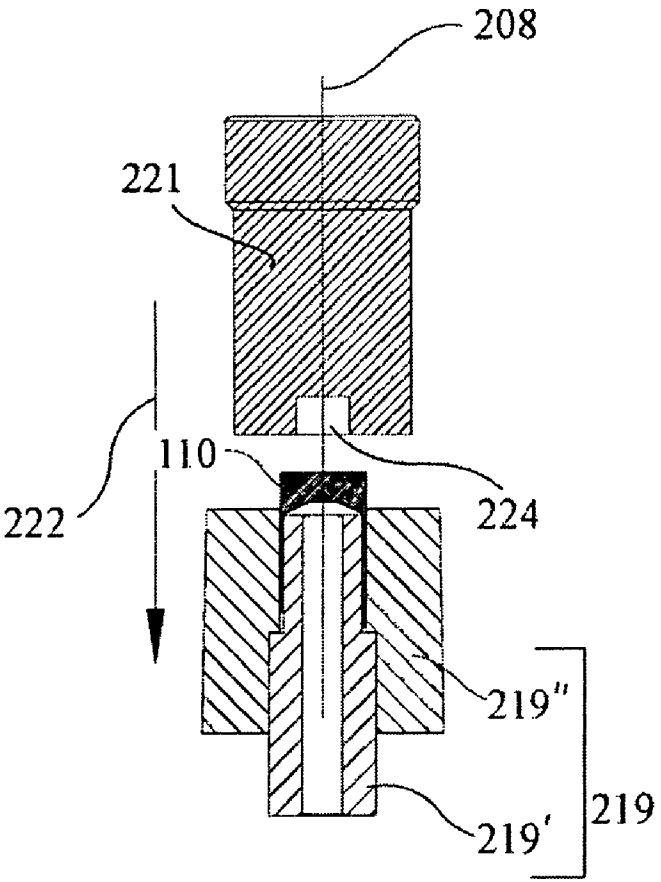

In another embodiment, FIGS. 14A-14C depict the step of compressing 28 second part 110 in the direction of arrow 222 with second punch 221, resulting in flattened disc 226 that is generally perpendicular to an axis passing longitudinally through first part 208. Because second punch 221 includes recess 224, a portion of second part 110 is forced upwards into recess 224 instead of being flattened to form disc 226. This results in boss 234 being formed or extruded contemporaneously with flattened disc 226. These steps shown in FIGS. 14A-14C for providing flattened disc 226 are known as upsetting. As shown, during the compressing 28 step where second part 110 is flattened into disc 226, first part 108 is securely held in place by second die 219 (or dies 219' and 219" that work together to hold first part 108) that is shaped with chamfers or other contours which results in the chamfers and/or contours being imparted to first part 108 after the compressing step.

Figure 15A:
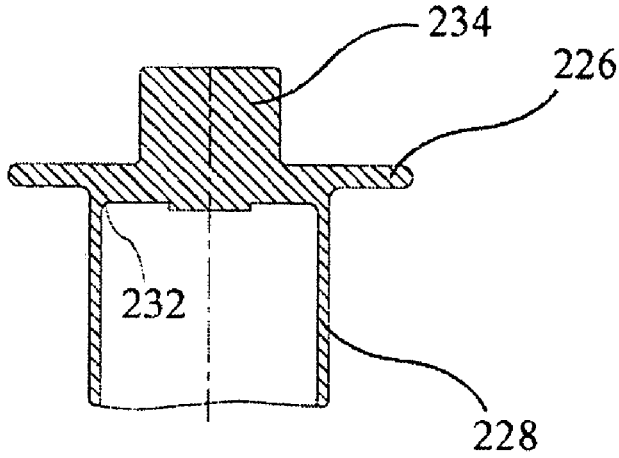
FIGS. 15A-15B depict the flattened disc with a boss provided by the method shown in FIG. 2.
Figure 15B:
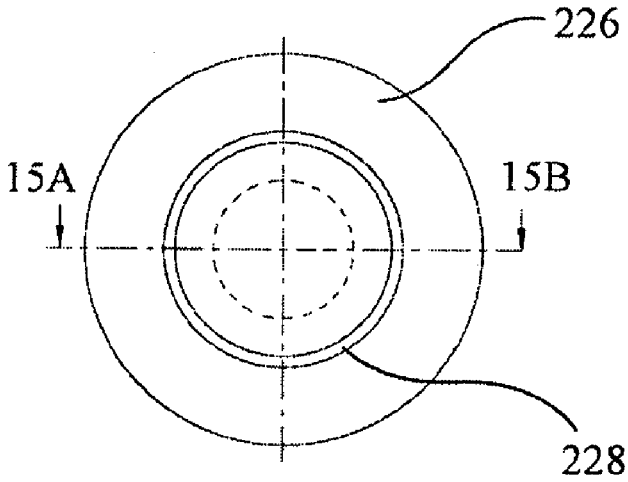

FIGS. 15A-15B depict armature housing 102 when second part 110 is compressed following the steps shown in FIGS. 14A-14C, where boss 234 is integrally attached to flattened disc 126 that in turn is integrally attached to raised wall 128, all of which define a single unit.

Figure 16C:
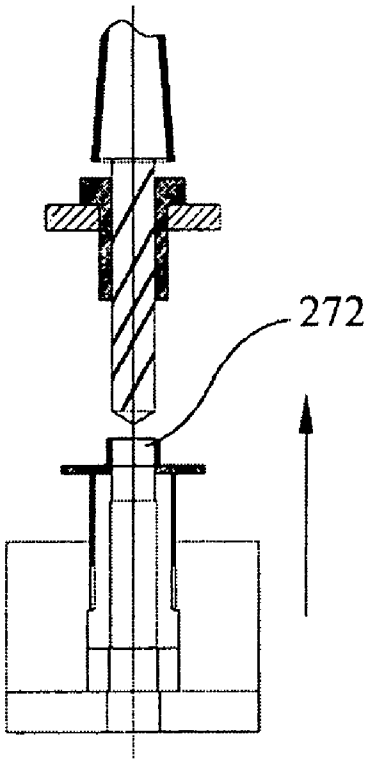
FIGS. 16A-16C depict the steps for drilling at least one hole in the boss and housing provided by the method shown in FIG. 2.
Figure 16B:
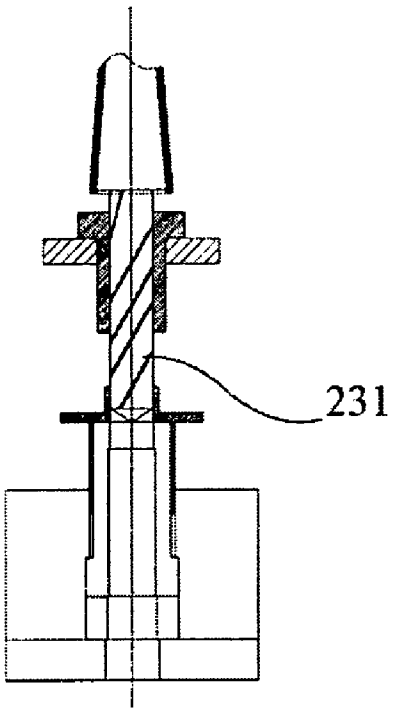
Figure 16A:
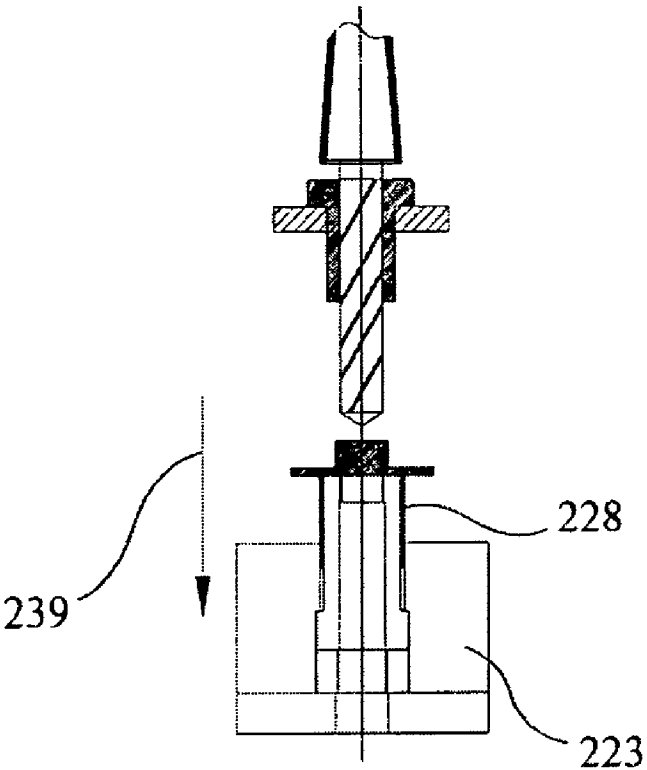
Figure 17A:
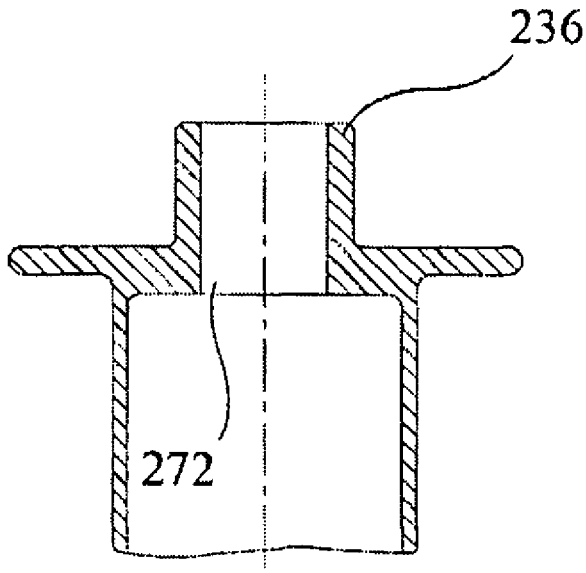
FIGS. 17A-17B depict the boss and flattened disc with a center hole provided by the method shown in FIG. 2.
Figure 17B:
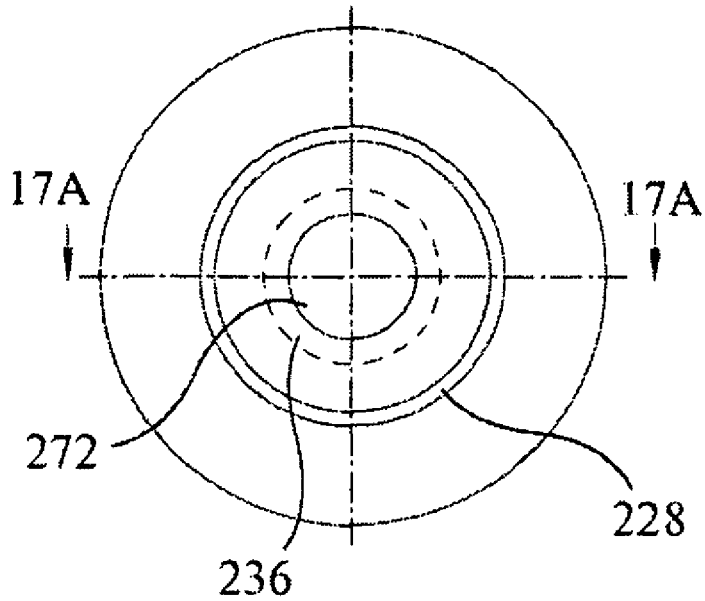

As shown in FIG. 2, some embodiments of method 20 include the step of placing 52 at least one hole in flattened disc 226. FIGS. 16A-16C depict raised wall 228 being held in place by die 223 and drill 231 being brought downwardly in the direction of arrow 239, where drill 231 makes contact with and passes through boss 234 to create hole 272 in a general center of boss 234 for defining second raised wall 236. See FIGS. 17A-17B. Alternatively, punch 131 from FIGS. 7A-7C is used to punch hole 272 in boss 234.

Optional embodiments of method 20 include polishing 58 the flattened disc to give housing 102 an aesthetically pleasing or shiny appearance. In some embodiments of method 20, method 20 includes the step of shaping 30 the first part and an area defined by a junction (item 132 of FIG. 6*a* that includes a chamfer) of the first part and a side of the flattened disc facing the first part.

Before any of the steps shown in FIGS. 2-13, material 106 and/or armature housing 102 is annealed 62, or stress relieved, between each step. In some embodiments, material 106 is magnetically annealed. In further embodiments, annealing is conducted between each step of method 20. Annealing is beneficial because it reduces stress introduced into material 106 during cold working, or during extruding, which occurs each time material 106 is pressed into dies, bent, or otherwise shaped. Without annealing, material 106 becomes more and more brittle after each cold working step, and material 106 becomes more and more difficult to shape in a subsequent cold working step and is more likely to crack or fail. The more often material 106 is annealed, the easier it is to extrude, or shape, material 106 in subsequent steps.

In one embodiment, the above extrusions or cold working steps are conducted at room temperature. In other embodiments, the temperature of the material is raised to facilitate extrusion and avoid the wait time between annealing, which is generally at an elevated temperature, and the above steps for working material 106.

Likewise, before any steps shown in FIGS. 2-13, material 106 and/or armature housing 102 is coated with phosphate to facilitate extruding material 106.

In one embodiment, annealing includes heating material 106 to approximately 850° C. and then allowing material 106 to stay at that temperature before furnace cooling material 106 to 720° C., and staying at this temperature prior to allowing material 106 to cool to room temperature.

However, costs and time involved in annealing may cause an operator to skip one or more annealing steps. In some embodiments, annealing is conducted during some of the steps set forth in FIGS. 2-13 or in method 20. All that is required is for annealing to be sufficient so that housing 102 may be provided by method 20. In further embodiments, annealing is conducted at least once during method 20 or during the steps set forth in FIGS. 2-13.

In a further embodiment of method 20, method includes the step of controlling 34 a cross section of the flattened disc relative to a cross section of at least a part of the raised perimeter, or raised wall. In other words, and referring to FIG. 13, the cross section of base 134 is controlled to be smaller, bigger, or the same as a cross section of the raised perimeter 128. More particularly, the thickness 135, 135' of base disc 128 is controlled relative to thickness 137 of raised wall 128.

As shown, the method increases 46 a thickness of the flattened disc to be greater than a thickness of the raised perimeter, or raised wall because a larger thickness 135 facilitates the flow of electricity, current, electrical energy, magnetic energy, and/or electromagnetic fields as it is transmitted from flattened disc 128 to raised wall 128. As shown, disc 126 has thickness 135 that increases toward the center of disc 126 relative to thickness 135' of its outer perimeter.

In another embodiment, method reduces 46 thickness 137 of raised perimeter to be less than thickness 135 of the flattened disc. A larger thickness 135 has more material for conducting an electromagnetic field or allowing a flow of electromagnetic energy as opposed to a thinner disc 126, particularly when the electromagnetic field is to reach the outwardly located raised wall 128. As shown in FIGS. 3A-3B, raised wall 128 is made thinner than base disc 126 by punch 112 being closer in a radial direction to first die 115, resulting in wall 128 being compressed or squeezed and resulting in thickness 137 being less than thickness 135. 135' and wall 138 being elongated, or stretched, away from disc 126.

Figure 1A:
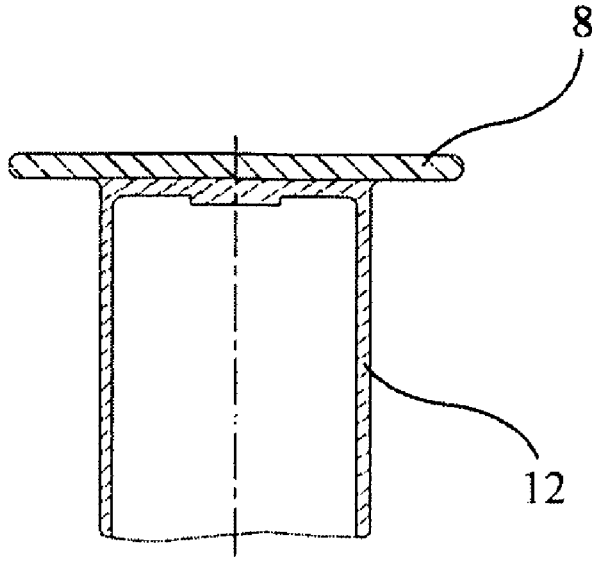
FIG. 1A PRIOR ART
FIGS. 1*a*-1B depict the prior art.
Figure 1B:
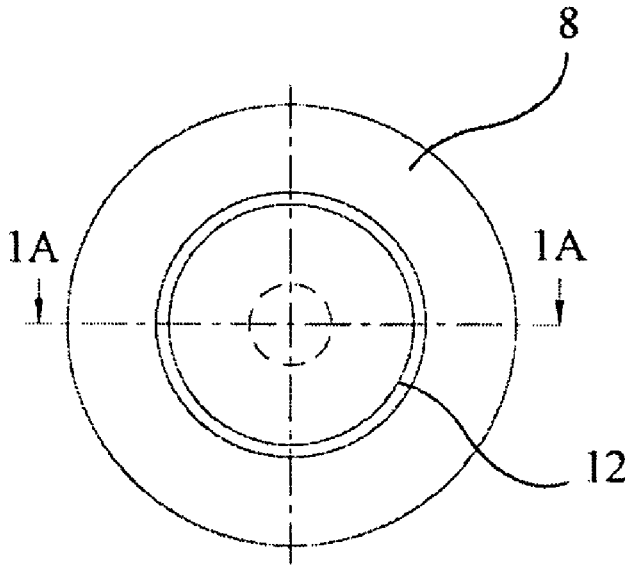
FIG. 1B PRIOR ART

Prior art armature housings made from sheet metal to form the base and raised wall that is then welded to the center pole are not able to achieve the aforementioned cross sectional control (see FIG. 1B) and therefore are limited in its ability to facilitate the electromagnetic field flow from disc 126 to wall 128.

In another embodiment and another advantage over the prior art, method 20 includes the step of orienting 36 a plurality of grain lines of flattened disc 126 to be in a generally radial direction. As stated above, the electromagnetic field is transmitted from flattened disc 126 to raised wall 128. In addition to controlling 34 a cross section of flattened disc 126, including a thickness, for facilitating transmission of the electromagnetic field through flattened disc 126, orienting 36 the plurality of grain lines of the flattened disc in a generally radial direction further facilitates transmission of the electromagnetic field because the electromagnetic field passes along the generally radial direction of the grain lines as the energy moves toward raised wall 128.

In typical prior art housings where the grain lines are not oriented, the grain lines may be oriented in a randomized, perpendicular, or angular relation relative to the travel of the electromagnetic field, in which case the grain lines inhibit the flow of the electromagnetic field rather than facilitate the flow.

Because method 20 compresses second end 110, second end 110 spreads outwardly, or the diameter of second end 110 increases in size, thereby resulting in flattened disc 126. As second end 110 spreads outwardly, the grain lines within disc 126 also moves in the outward direction and automatically orients themselves in a generally radial direction, or the outward direction in which second end 110 spreads.

In a further embodiment and another advantage over the prior art, method 20 includes the step of orienting 40 a plurality of grain lines of first part 108 to be in a generally axial direction extending along a length of the first part. As stated above, electromagnetic field extends axially along a length or height of raised perimeter 128. Therefore, orienting 40 the plurality of grain lines of first part 108 to be in a generally axial direction facilitates transmission of the electromagnetic field through raised perimeter 128 or wall. See FIG. 13 for an illustration of housing 102 with grain lines 104 oriented as described above.

In typical prior art housings where the grain lines are not oriented, the grain lines may be randomized, perpendicular, or angular relative to the travel of the electromagnetic field, in which case the grain lines inhibit the flow of energy rather than facilitate the flow.

Because method 20 extrudes first end 108 by pushing material 106 into first die 115 in a longitudinal direction along the length of first end 108, the grain lines within first end 108 likewise also moves in the longitudinal direction along the length of first end 108, or in the direction first end 108 is extruded.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

The invention claimed is:

1. A method of providing an armature housing, comprising the steps of:

providing a solid cylinder of malleable material having a first part and a second part;

extruding at least a part of a perimeter of the first part in a direction away from the second part for defining a raised wall;

compressing the second part in an axial direction toward the first part, resulting in a solid, flattened disc generally perpendicular to the first part; and reducing a thickness of the raised wall to be less than a thickness of the solid, flattened disc for facilitating a flow of energy; and magnetically annealing the armature housing after each of the steps of: providing a solid cylinder of malleable material having a first part and a second part; extruding at least a part of a perimeter of the first part in a direction away from the second part for defining a raised wall; compressing the second part in an axial direction toward the first part, resulting in a solid, flattened disc generally perpendicular to the first part; and reducing a thickness of the raised wall to be less than a thickness of the solid, flattened disc;

wherein the first part, second part, and at least part of the perimeter are all integrally connected as a single piece.

2. The method according to claim 1, further comprising the step of placing at least one hole in the solid, flattened disc.

3. The method according to claim 1, further comprising the step of cutting the solid, flattened disc.

4. The method according to claim 1, further comprising the step of shaping the solid, flattened disc.

5. The method according to claim 1, further comprising the step of polishing the first part and the second part.

6. The method according to claim 1, further comprising the step of shaping an area defined by a junction of the first part and the second part.

7. The method according to claim 1, further comprising the step of magnetically annealing the armature housing after at least one of the steps of:

providing a solid cylinder of malleable material having a first part and a second part;

extruding at least a part of a perimeter of the first part in a direction away from the second part for defining a raised wall;

compressing the second part in an axial direction toward the first part, resulting in a solid, flattened disc generally perpendicular to the first part;

extending a central part of the solid, flattened disc away from the first part, resulting in a boss;

placing at least one hole in the solid, flattened disc and the boss; and shaping the solid, flattened disc.

8. The method according to claim 1, further comprising the step of controlling a cross section of the solid, flattened disc relative to a cross section of the at least part of the raised wall.

9. The method according to claim 1, further comprising the step of orienting a plurality of grain lines of the solid, flattened disc to be in a generally radial direction extending outwardly from a general center of the solid, flattened disc.

10. The method according to claim 1, further comprising the step of orienting a plurality of grain lines of the first part to be in a generally axial direction extending along a length of the raised wall.

11. The method according to claim 1, further comprising the step of extending a central part of the solid, flattened disc away from the first part, resulting in a boss.

12. A method of providing an armature housing, comprising the steps of:

providing a solid cylinder of malleable material having a first part and a second part;

extruding at least a part of a perimeter of the first part in a direction away from the second part for defining a raised wall;

compressing the second part in an axial direction toward the first part, resulting in a solid, flattened disc generally perpendicular to the first part;

reducing a thickness of the raised wall to be less than a thickness of the solid, flattened disc for facilitating a flow of energy;

orienting a plurality of grain lines of the solid, flattened disc to be in a generally radial direction extending outwardly from a general center of the solid, flattened disc;

orienting a plurality of grain lines of the first part to be in a generally axial direction extending along a length of the raised wall; and magnetically annealing the armature housing after each of the steps of: providing a solid cylinder of malleable material having a first part and a second part; extruding at least a part of a perimeter of the first part. in a direction away from the second part for defining a raised wall; compressing the second part in an axial direction toward the first part, resulting in a solid flattened disc generally perpendicular to the first part; reducing a thickness of the raised wall to be less than a thickness of the solid, flattened disc; orienting a plurality of grain lines of the solid, flattened disc; and orienting a plurality of grain lines of the first part; and wherein the first part, second part, and at least part of the perimeter are all integrally connected as a single piece.

13. A method of providing an armature housing, comprising the steps of:

providing a solid cylinder of malleable material having a first part and a second part;

extruding at least a part of a perimeter of the first part in a direction away from the second part for defining a raised wall;

compressing the second part in an axial direction toward the first part, resulting in a solid, flattened disc generally perpendicular to the first part;

reducing a thickness of the raised wall to be less than a thickness of the solid, flattened disc for facilitating a flow of energy;

placing at least one hole in the solid, flattened disc;

shaping the solid, flattened disc;

magnetically annealing the armature housing after each of the steps of:

providing a solid cylinder of malleable material having a first part and a second part;

extruding at least a part of a perimeter of the first part in a direction away from the second part for defining a raised wall;

compressing the second part in an axial direction toward the first part, resulting in a solid, flattened disc generally perpendicular to the first part;

reducing a thickness of the raised wall to be less than a thickness of the solid, flattened disc;

placing at least one hole in the solid, flattened disc; and shaping the solid, flattened disc; and wherein the first part, second part, and at least part of the perimeter are all integrally connected as a single piece.

* * * * *